US005549342A

United States Patent [19]

Donaldson et al.

[11] Patent Number: 5,549,342

[45] Date of Patent: Aug. 27, 1996

[54] MANHOLE DEBRIS CATCHER

[75] Inventors: Jeffrey E. Donaldson; Andrew J. Sullivan, both of Eden Prairie, Minn.

[73] Assignee: Virtual Industries, Inc., Eden Prairie, Minn.

[21] Appl. No.: 382,965

[22] Filed: Feb. 2, 1995

[51] Int. Cl.[6] ..... B66C 1/12; B66C 1/16

[52] U.S. Cl. ..... 294/77; 294/68.1; 405/303

[58] Field of Search ..... 294/68.1, 68.22, 294/77; 405/52, 303; 52/19, 20

[56] References Cited

U.S. PATENT DOCUMENTS 1,932,527 10/1933 Long ..... 294/77

2,813,745 11/1957 Frieder et al. ..... 294/77

4,398,760 8/1983 Kirk ..... 294/77

*Primary Examiner*—Michael Powell Buiz

*Assistant Examiner*—James A. Lisehora

*Attorney, Agent, or Firm*—Palmatier, Sjoquist & Helget, P.A.

[57] ABSTRACT

A manhole debris catcher having a flat mat with open tubular pockets spaced radially about a center point at approximate equal angle, with a center support base and straps threaded through the pockets and through openings through the center support base, and a ring lifting assembly attached via lines to the ends of each of the straps; side braces may be inserted into each of the pockets to assist in maintaining the mat in flat form.

16 Claims, 2 Drawing Sheets

MANHOLE DEBRIS CATCHER

BACKGROUND OF THE INVENTION

The present invention relates to an apparatus for retrieving debris and the like from locations which are accessible through vertical passages. More particularly, the invention relates to an apparatus for retrieving materials from the bottom of a structure such as a street manhole.

During the process of repairing or cleaning street manholes it is not unusual for pieces of the manhole structure, or pieces of the materials used for repair of the manhole structure, to break away and fall to the bottom of the manhole. Such debris must be removed from the manhole after the work has been completed or it can accumulate to obstruct the flow of liquid through the pipe system to which the manhole is connected. In the case of a typical city sanitary or storm sewer system, if obstructions are placed into the flow system it is likely that sewer backup will occur, resulting in damage to systems and property connected to the sewer system. Because of the limited and restricted size of manholes it is difficult for a person to enter into the manhole for cleaning and debris removal purposes. Furthermore, the interior of a manhole is usually poorly lighted making it difficult to locate debris which may have fallen into it.

There is, therefore, a need for some type of device which can facilitate the removal of debris from manholes, particularly after a work project has been completed. It would be advantageous if such a device could be inserted into the manhole before the work project is begun and then removed at the completion of the work project together with all the debris which was created as a result of the work.

SUMMARY OF THE INVENTION

The present invention comprises a collapsible carrier which may be lowered into a manhole in its collapsed condition and then opened to form a debris collection mat which will lay on the bottom surface of the manhole and which may be retrieved from above by closing the mat about the collected material, and the mat and material can then be lifted from the manhole with the mat in its collapsed or partially collapsed condition. The invention includes a circular mat with a plurality of loops spaced about its periphery and with a short length of cable or rope attached to each of the loops. All of the cables or ropes are brought together and connected to a central lifting assembly, and the lifting assembly may be readily retrieved by a hook lowered into the manhole from above.

It is a principal object of the present invention to provide a debris removal device for manholes and the like, wherein the device may be lowered into the manhole and retrieved from the manhole without requiring a person to enter the manhole.

It is another object and advantage of the present invention to provide a manhole debris removal device which is collapsible into a small size for ease of ingress and egress from a manhole.

It is another object and advantage of the present invention to provide a debris removal device which is lightweight and easy to manipulate.

It is another object and advantage of the present invention to provide a debris removal device which may be inserted into a manhole and does not require any connection to the surface of the manhole or to the manhole entry point until it is desired to remove the device from the manhole.

The foregoing and other objects and advantages will become apparent from the following specification and claims, and with reference to the drawings.

DESCRIPTION OF THE PREFERRED EMBODIMENT

Figure 1:
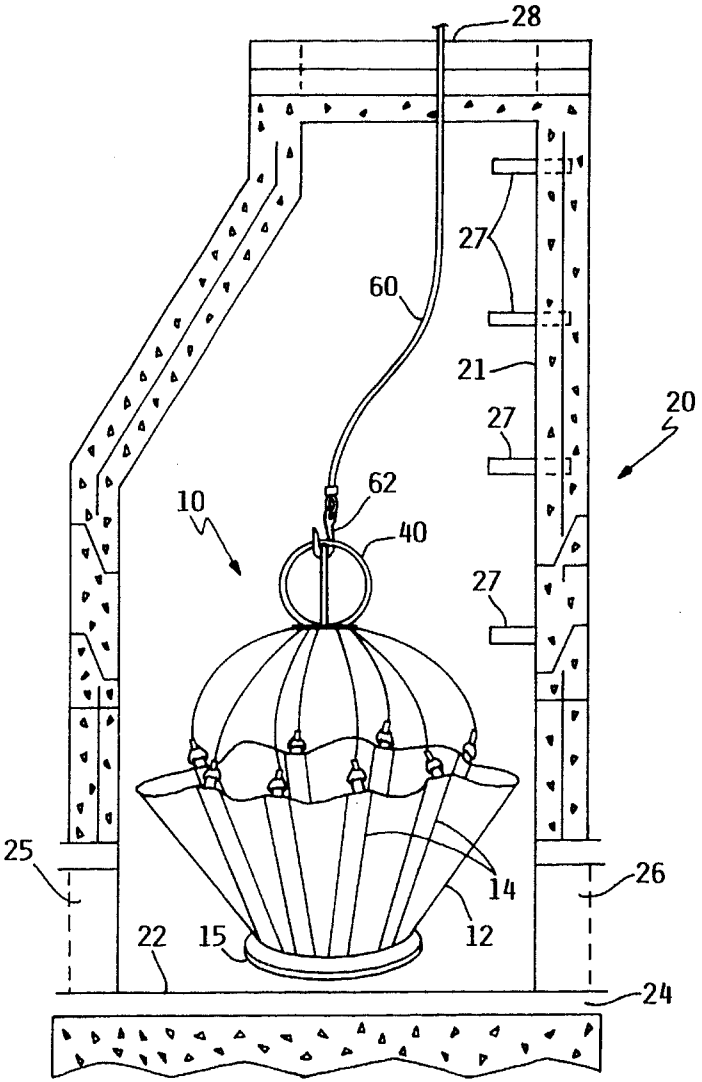
FIG. 1 shows a typical application of the invention.
Figure 3:
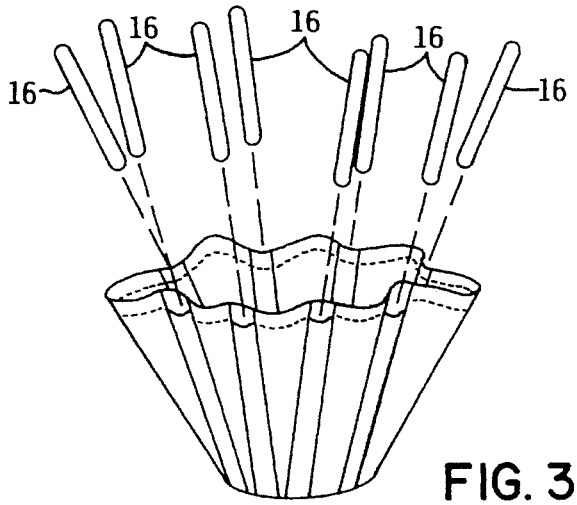
FIG. 3 shows an isometric partial view of the invention.
Figure 4:
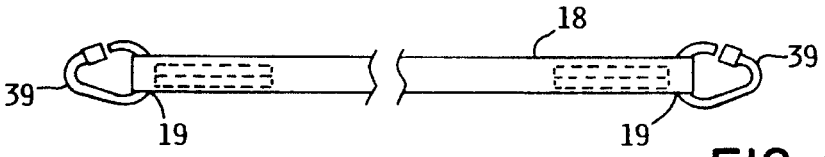
FIG. 4 shows one of the belts used with the invention.
Figure 5:
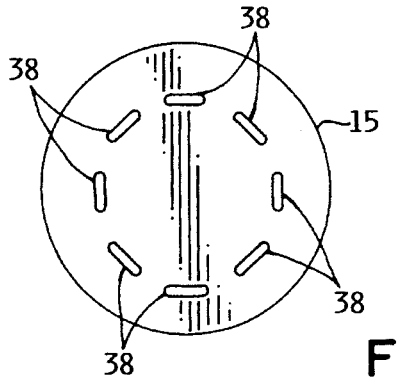
FIG. 5 shows the bottom support plate of the invention.
Figure 6:
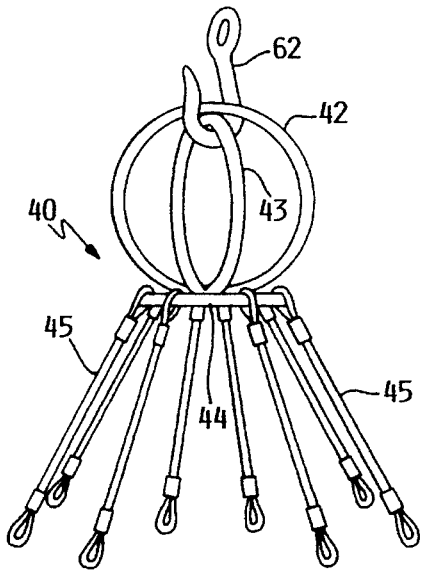
FIG. 6 shows the lifting ring assembly.

Referring first to FIG. 1, a typical application of the invention is shown. The manhole debris catcher 10 is lowered into a manhole 20 until the bottom support plate 15 rests on the lower surface 22 of manhole 20. In a typical sanitary or storm sewer manhole, an invert, or channel, 24 runs through the bottom of the manhole to provide a flow path between the sewer pipes 25, 26 which are connected to the manhole 20. Access to manhole 20 is typically provided by a removable cover 28, and a plurality of metal rungs 27 project outwardly from the interior wall 21 of the manhole 20 to form a ladder.

The construction of the debris catcher can best be understood with reference to FIGS. 2–6, in conjunction with FIG. 1. A generally circular mat 12 forms the debris collection surface for the apparatus. Mat 12 is preferably constructed from nylon and vinyl materials which are vulcanized together to form a tough, tear-resistant canvas-like fabric. A plurality of pockets 14 are stitched about mat 12 and are radially aligned at equal angular distances about mat 12, each pocket 14 providing a radial sleeve which is open at both ends. A plurality of further pockets may be formed in the interior of pockets 14 for the purpose of holding a plurality of side braces 16 (see FIG. 3). If such further pockets are formed, it is preferable that each of the further pockets be closed at its inner end and opened at its outer end in order that side braces 16 may be inserted into these inner pockets and be held within the closed inner end of the inner pockets. A plurality of side braces 16, one for each pocket 14, are removably insertable into the pockets 14. Side braces 16 are preferably made from fiberglass and serve as strengthening braces for the sidewall surface of mat 12, particularly when mat 12 is loaded with debris and is lifted. Side braces 16 also serve to flatten mat 12 when it is lowered onto the bottom manhole surface.

Side braces 16 could be eliminated from the invention, but the best purposes of the invention would then be degraded, for it would be more difficult to arrange the mat into a flat form on the floor of the manhole.

Although the preferred embodiment of the invention utilizes a mat 12 which is generally octagonal in shape and has a width dimension of about four feet, it is apparent that other geometric shapes and sizes would also function adequately. For example, mat 12 could be made circular, square, rectangular, or with some other geometric shape. In such cases the pockets 14 would be formed in a similar manner, along lines radiating from a center point and extending outwardly toward a peripheral edge. The number of pockets 14 is selected so as to provide a relatively even distribution of straps 18 for lifting the debris catcher as described herein.

Figure 2:
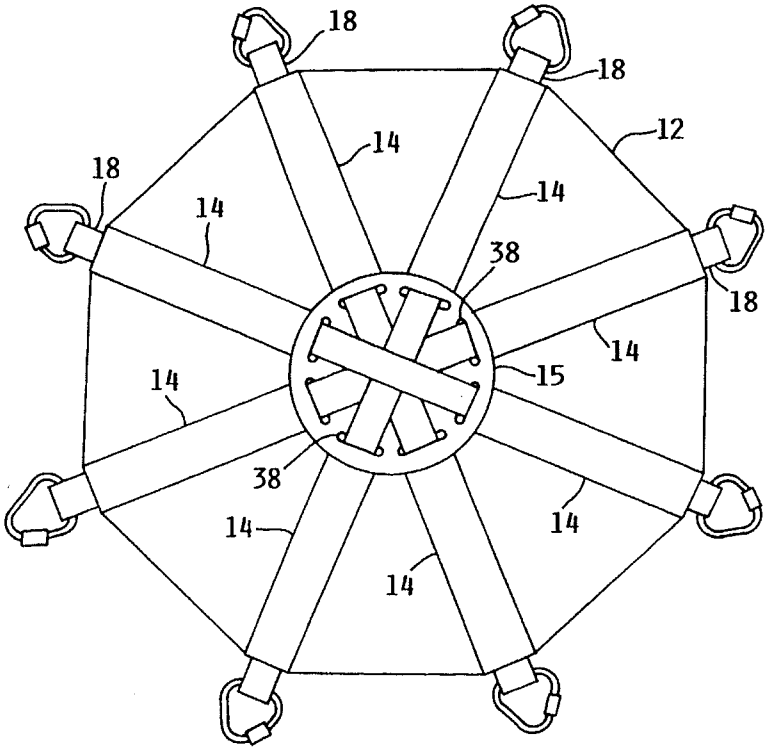
FIG. 2 shows a bottom view of the invention.

Support straps 18 are threaded through pockets 14 as illustrated in FIG. 2. Support straps 18 are also threaded through openings 38 in support plate 15 to form a crossing pattern as shown in FIG. 2. The respective ends of support straps 18 are stitched to form loops 19, and a quick connector 39 is fed through each loop 19. Support straps 18 are preferably made from latex-treated polyester web strapping material, capable of supporting a very heavy weight. Quick connectors 39 are commercially available connectors having threaded fittings for assembly and disassembly to loops 19.

Support plate 15 is preferably made from a strong and flexible metal or plastic, and is sized to bridge a typical manhole invert, whereby the debris catcher 10 may be dropped to the lower surface of the manhole with support plate 15 resting on the surface over the invert so as to not interfere with the flow of liquid through the invert. A preferable size for support plate 15 is about 15 inches in diameter.

Support plate 15 is preferably attached as shown in FIG. 2, although an alternative embodiment of the invention could be constructed without using a support plate. In such case, the straps 18 would be threaded through the pockets 14 in a similar manner forming a crossing pattern at the center of mat 12 without benefit of a support plate. This form of alternative embodiment would function adequately for lifting purposes but would be slightly more difficult to arrange in a flat form on the bottom surface of a manhole.

A lifting ring assembly 40 is made from three circular steel rings 42, 43 and 44, which are welded together to form a rigid assembly. The rings 42, 43 are preferably made at least about eight inches in diameter to provide a large assembly for ease of hooking onto and also to keep the assembly accessible even after a certain amount of debris has accumulated on mat 12. Rings 42 and 43 are welded to form two lifting rings aligned at 90° from each other, and ring 44 is welded to the lower edges of both rings 42 and 43 to form a cable attachment ring. A plurality of cables 45, one cable for each quick link 39, are attached to cable attachment ring 44 in a manner that permits the cables 45 to be equally spaced about the cable attachment ring 44. The other ends of each of the cables 45 are attached to quick links 39, each cable end being attachable by use of the threaded fitting of each quick link 39.

Although the preferred embodiment of the invention utilizes three circular steel rings, alternative embodiments could use different geometric shapes; for example, rings 42, 43 could be square or octagonal in shape, and ring 44 could be octagonal or have the same number of sides as the number of strap 18 ends. It is important that rings 42, 43 be mutually arranged so as to have a three-dimensional form to facilitate grasping onto the rings by a hook lowered from above. An alternative form which would also function, but in a less satisfactory manner, would utilize a line fixedly attached to the lifting ring assembly for purposes of lowering the debris catcher from above. However, this form has the disadvantage that the line must remain with the debris catcher and must be secured at its top end so that it always projects out of the manhole, which could interfere with the normal work functions conducted inside the manhole.

In operation, the debris catcher 10 is lowered into a manhole by a cable or rope 60 having a lower hook 62, which is hooked onto one of the lifting rings 42, 43. At the bottom of the manhole, the support plate 15 rests on the manhole floor and supports mat 12 which is spread over the manhole floor surface. The lowering rope or cable 60 is detached from the debris catcher by becoming unhooked when the lifting rings contact the manhole floor, and the rope and hook may be removed from the manhole. While it is laying on the manhole floor, the mat 12 catches all debris which may fall into the manhole as a result of work or other activity, and a pile of debris may accumulate on mat 12. After the mat 12 becomes sufficiently full of debris, or when the work project is completed, the rope 60 and hook 62 are again lowered into the manhole, and the hook 62 is manipulated to hook onto one of the lifting rings 42,43. The debris catcher 10 may then be lifted out of the manhole while holding its collection of debris, for the lifting action of ring 44 will cause the outer periphery of mat 12 to close toward ring 44 and thereby confine the collected debris within the closed shape formed thereby.

The present invention may be embodied in other specific forms without departing from the spirit or essential attributes thereof; it is, therefore, desired that the present embodiment be considered in all respects as illustrative and not restrictive, reference being made to the appended claims rather than to the foregoing description to indicate the scope of the invention. For example, the invention can be constructed in other forms and remain within the scope of the invention; the invention can be constructed in a form which is amenable to lowering through a chimney to a fireplace or firebox for debris collection purposes. Of course, in such application the size and construction details will vary from the description of the preferred embodiment.

What is claimed is:

1. A debris retrieval apparatus, comprising:

(a) a mat having peripheral edges and a center point, said mat further comprising a plurality of elongated pockets formed at substantially equal angles radially from said center point, each of said pockets extending from proximate a peripheral edge toward said center point, and each of said pockets being open at its end points;

(b) a plurality of straps threaded through said pockets, each strap having an end proximate a pocket opening at a first peripheral edge and having an end proximate a pocket opening at a second peripheral edge, said strap being aligned along a straight line passing through said center point; and (c) a lifting ring assembly connected to said strap ends by a plurality of lines, said lifting ring assembly having at least two substantially orthogonal loops for providing a three-dimensional form.

2. The apparatus of claim 1, further comprising a support plate having a plurality of openings arranged at said substantially equal angles, wherein said plurality of straps are threaded through said openings to position said support plate proximate said center point.

3. The apparatus of claim 1, further comprising a plurality of inner pockets, each inner pocket being formed along the interior of one of said plurality of elongated pockets and each inner pocket having a closed inner end.

4. The apparatus of claim 3, further comprising a plurality of elongated side braces, each brace sized for fitting into one of said inner pockets.

5. The apparatus of claim 1, wherein each of said strap ends further comprise a stitched loop; and further comprising a detachable link connected through said stitched loop and attached to one of said plurality of lines.

6. The apparatus of claim 1, wherein said lifting ring assembly further comprises a pair of rings affixed together at approximate orthogonal positions, and a third ring affixed to said pair of rings, said lines being attached to said third ring.

7. The apparatus of claim 6, wherein said pair of rings each have a diameter of at least about eight inches.

8. The apparatus of claim 1, wherein said mat further comprises a material made from nylon and vinyl vulcanized together.

9. The apparatus of claim 8, wherein said mat further comprises a material in a generally octagonal shape.

10. An apparatus for collecting debris, comprising:

(a) a mat surface having a generally octagonal shape with peripheral edges and a center point, said mat surface having a tubular pocket associated with each of the octagonal sections of said shape, each said tubular pocket having open pocket ends;

(b) a substantially flat support base positioned proximate the center point of said mat, said support base having openings therethrough respectively aligned with each of said pockets;

(c) a plurality of straps, each strap threaded through two of said pockets and two openings of said support base aligned with said pockets, and each of said straps respectively having looped ends projecting outwardly from said pockets beyond said mat peripheral edges; and (d) a lifting ring assembly comprising at least two ring loops, and a plurality of lines connected between said lifting ring assembly and said strap looped ends, with one line connected to each strap looped end.

11. The apparatus of claim 10, further comprising a plurality of side braces, each side brace sized to fit into one of said pockets.

12. The apparatus of claim 10, wherein said ring assembly further comprises a pair of mutually orthogonal circular rings affixed together, and a third circular ring affixed to said pair of rings wherein said plurality of lines are attached to said third ring.

13. The apparatus of claim 12, wherein each of said pair of rings further comprise a diameter of at least about eight inches.

14. The apparatus of claim 12, further comprising detachable links connected between each of said strap looped ends and each of said lines.

15. The apparatus of claim 12, wherein said support base further comprises a circular plate having a diameter sufficiently large so as to overlap at least a portion of the inner ends of said pockets, wherein said openings are aligned with the inner ends of said pockets.

16. The apparatus of claim 12, wherein said mat further comprises a material made from nylon and vinyl vulcanized together to form a unitary sheet.

* * * * *